US005630348A

United States Patent [19]

Kuchler

[11] Patent Number: 5,630,348

[45] Date of Patent: May 20, 1997

[54] SLICING MACHINE WITH CIRCULAR BLADE

[76] Inventor: Fritz Kuchler, Klatteweg 4 - 6, A-9010 Klagenfurt, Austria

[21] Appl. No.: 359,704

[22] Filed: Dec. 20, 1994

[30] Foreign Application Priority Data

Dec. 21, 1993 [AT] Austria ..... 2585/93

[51] Int. Cl.[6] ..... B26D 5/26

[52] U.S. Cl. ..... 83/713; 83/62; 83/435.25; 83/DIG. 1; 83/932

[58] Field of Search ..... 83/58, 62, 375, 83/381, 435.1, 452, 458, 468.6, 663, 713, 859, 932, DIG. 1, 729, 268; 192/129, 129 R, 137

[56] References Cited

U.S. PATENT DOCUMENTS

| | | | |
|---|---|---|---|
| 2,196,371 | 2/1940 | Berkel | 83/713 X |
| 3,805,658 | 4/1974 | Scott et al. | 83/DIG. 1 X |
| 4,123,959 | 11/1978 | Schill | 83/874 |
| 4,813,316 | 3/1989 | Johnson et al. | 83/435.1 X |
| 4,958,547 | 9/1990 | Low | 83/DIG. 1 X |
| 5,224,407 | 7/1993 | Koch et al. | 83/468.7 X |
| 5,241,885 | 9/1993 | Kuchler | 83/DIG. 1 X |
| 5,461,957 | 10/1995 | Koch et al. | 83/713 X |

FOREIGN PATENT DOCUMENTS

| | | |
|---|---|---|
| 0146489 | 4/1992 | European Pat. Off. . |
| 2601269 | 3/1978 | Germany . |

*Primary Examiner*—Rinaldi I. Rada
*Assistant Examiner*—Boyer Ashley
*Attorney, Agent, or Firm*—Herbert Dubno

[57] ABSTRACT

A slicing machine in which the clamping device for pressing the product on the slicing machine carriage toward the stop plate is provided with a device for inactivating the blade motor and the drive for the stop plate so that, when the clamping device is in its upper inoperative position, the blade motor is deactivated and the stop plate is brought into the plane of the blade or forwardly thereof to prevent injury to an operator.

8 Claims, 2 Drawing Sheets

SLICING MACHINE WITH CIRCULAR BLADE

FIELD OF THE INVENTION

My present invention relates to a slicing machine of the circular blade type in which a carriage is displaceable past a connecting edge of the blade and the stop plate against which the product to be sliced is set back from the blade edge by a drive and the blade is driven by a motor. More particularly, this invention relates to a slicing machine of this type which has a clamping or pusher device which can press the product toward the stop plate and which can be swung upwardly into an inoperative position.

BACKGROUND OF THE INVENTION

To protect an operator from injury with such a slicing machine it has been found to be desirable to shield the operator from contact with the blade or to cut off the motor drive. For this purpose switch arrangements can be provided which interrupt the supply of electric current to the blade motor as soon as the blade is uncovered, e.g. for cleaning purposes.

The German patent document DE-A1 26 01 269 discloses a slicing machine which utilizes a switch as a protective device which must be separately actuated before the slicer is placed in operation by being actuated before each cutting operation.

U.S. Pat. No. 4,123,959 and European patent document EP-A1 146,489 describe slicing machines which attempt to avoid injury by protective devices provided on the machine.

There are slicing machines in common use and on the market in which the stop plate is set back to establish the slice thickness by the parallel spacing between the stop plate and the blade plane. There are also machines which determine the slice thickness by the stepping of the product in predetermined increments. In this case, the stop plate can be set back by an amount which is greater than the increment of advance of the product. For safety reasons in both cases, the set back of the stop plate only occurs immediately prior to or concurrently with the slicing operation so that the stop plate will lie in the blade plane prior to the cutting operation and is returned thereto after slice formation to shield the cutting edge of the blade against contact by the operator.

OBJECTS OF THE INVENTION

It is the principal object of the present invention to further increase the safety of slicing machines of the aforedescribed type.

Another object of this invention is to provide a slicing machine in which the chances of injury to the operator are reduced without interfering with the ability to use the slicer in an efficient manner or to clean the slicer.

SUMMARY OF THE INVENTION

These objects are attained, in accordance with the present invention, by providing an electrical device for signalling the position of the clamping unit and, when the latter is swung into its upper or inoperative position, will reset the drive for the stop plate and de-energize or inactivate the blade motor, the stop plate being moved into an edge-shielding position.

It has been found that the position of the clamping device on the machine is an especially advantageous criterion for the activation of the blade motor and the stop plate. When the clamping device is in its operative position, a product to be sliced is present between the clamping plate and the stop plate and it is difficult for injury to occur. When, however, the clamping device is swung upwardly or is in its inoperative position and no product is on the carriage, the blade is accessible to the hand of the operator and thus, in accordance with the invention, the stop plate is retracted to the blade plane and the blade motor is de-energized so that both the stop plate drive and the blade motor can only be energized when a product is on the carriage and is engaged by the clamping device.

More particularly, the slicing machine of the invention can comprise:

a slicing-machine bed;

a slicing blade rotatable about an axis in a blade plane perpendicular to the axis and provided with a motor for driving the blade;

a carriage for a product to be sliced displaceable on the bed transversely to the axis for slicing of the product as the carriage is moved past a cutting edge of the blade;

a stop plate mounted on the bed, disposed alongside the blade and shiftable on the bed between a slicing position wherein the plate is set back from the blade by a distance of at least a slice thickness and a shielding position wherein the stop plate is disposed forwardly of the slicing position and shields the edge against injury to an operator;

a drive for shifting the stop plate between the positions;

a clamping device swingable between an operative lower position wherein the device urges a product on the carriage against the stop plate and an inoperative upper position; and means for detecting a position of the device for inactivating the drive and the motor in the upper position of the device.

Advantageously, the signalling system can comprise a magnetic strip which extends in the direction of carriage displacement below the carriage and at least one reed contact on the machine housing below the magnetic strip, the magnetic strip being retracted from a position in which it can operate the switch to signal one or the other of the positions of the clamping device. It has been found to be advantageous to provide the swingable arm of the clamping device with a projection or cam which can cause the magnetic strip to be drawn away from the reed switch upon displacement of the clamping device into its upper inoperative position.

The magnetic strip can have a length which enables the reed switch or a group of reed switches spaced by less than the length of the magnetic strip or a distance substantially equal to this length so that at least one reed switch is affected by the magnetic strip independently of the position of the carriage along its path.

If the magnetic strip is raised, e.g. by swinging of the clamping arm into its upper position, the reed switch opens to prevent energization of the stop plate drive and the blade motor.

When the magnetic strip lowers, the reed contacts can be closed. The reed contacts are in circuit with the blade motor and the positioning drive or the stop plate and can reset the stop plate into the plane of the blade when the clamping device is raised. The blade motor also cannot operate in this condition.

The linkage between the magnetic strip and the clamping device can be mechanical levers, rods or cams. A bar can, for example, be interposed between the arm and the magnetic strip or a cam and cam follower stem can be used for this purpose.

It has been found to be advantageous to provide a plurality of reed contacts along the path of the slicing carriage, thereby permitting the length of the magnetic strip to be reduced. It is sufficient that the magnetic strip be capable of bridging two such reed switches.

To enable the machine to be more readily cleaned, the carriage can be swung about an axis parallel to its displacement, thereby moving the magnetic strip away from the reed switch or reed switches and ensuring in this cleaning position that the motor will be cut off and the drive for the stop plate in the position in which the stop plate shields the cutting edge of the blade.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
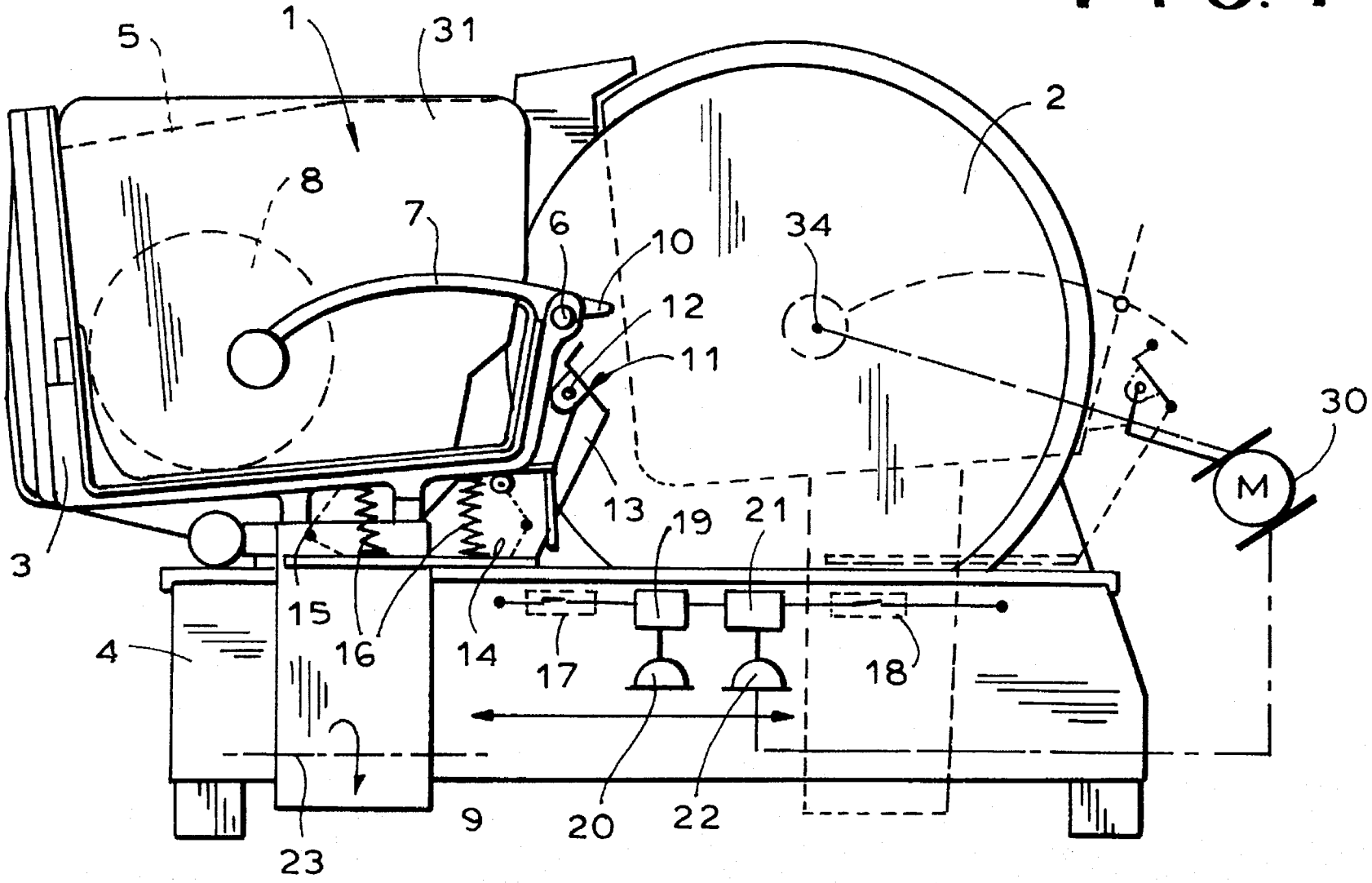
FIG. 1 is a side view of a portion of a slicing machine in which the pusher plate for the product to be sliced is in its lowered (operative) position.
Figure 2:
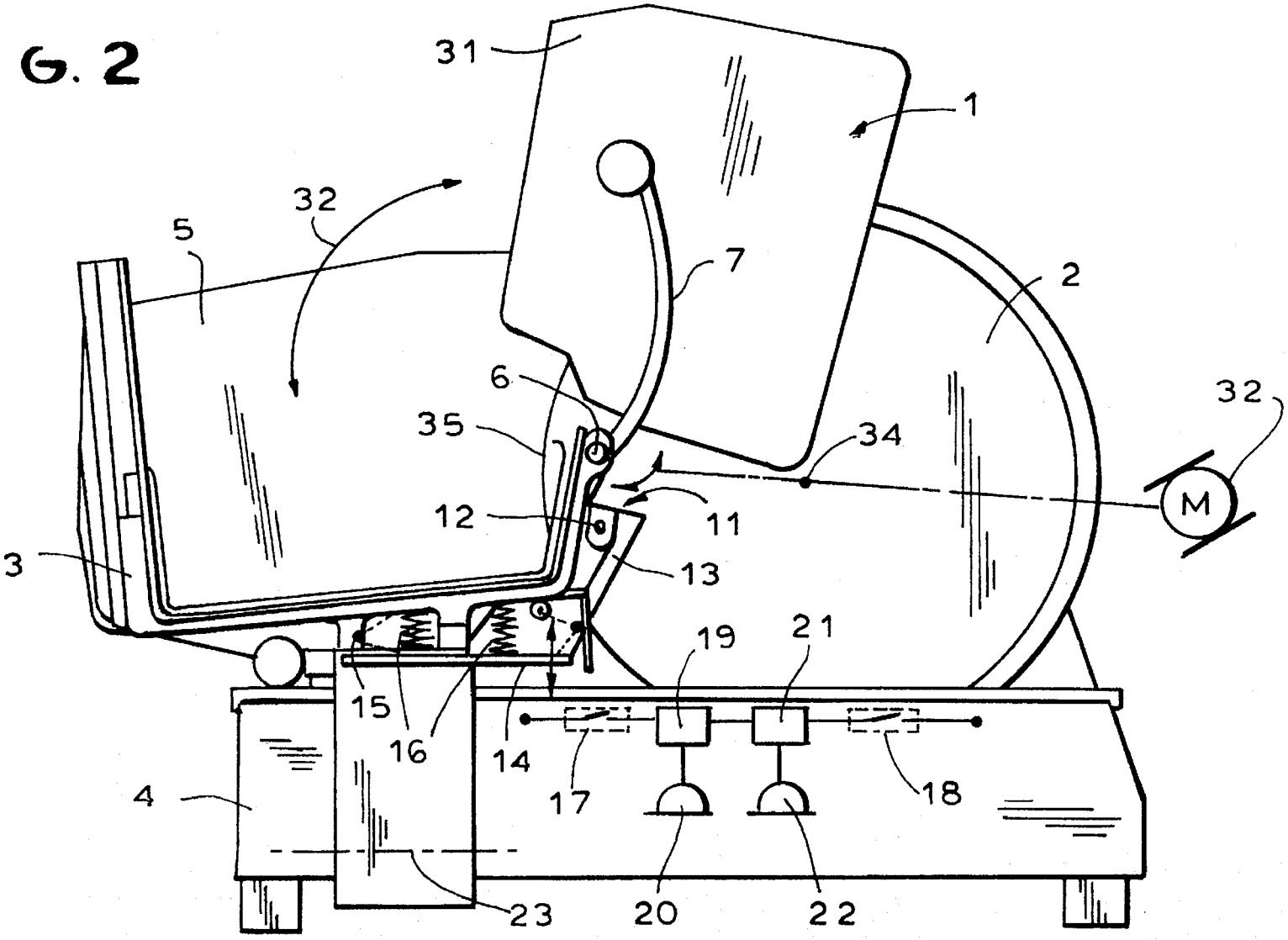
FIG. 2 is a similar view of the machine with the pusher plate in its upper (open or inoperative) position.

A slicing machine according to the invention can comprise, as is customary, a pushing or clamping device 1 which engages the comestible product to be sliced, e.g. a sausage represented at 8, for advancing that product toward a stop plate 5 on a carriage 3 which is displaceable back and forth transversely to the axis of rotation of a circular blade 2 driven by a motor represented at 30 in FIGS. 1 and 2. In FIG. 1, the clamping device 1, with its pusher plate 31 mounted on the arm 7 is shown in its operative position in which it is juxtaposed with the stop plate 5 and the food product 8 is received between the plates 5 and 31.

In FIG. 2, the plate 31 of the clamping device 1 is shown in its raised or upper position, i.e. in the open or inoperative position, allowing the food product to be placed upon the carriage 3 or removed therefrom. The pivot motion of the plate 31 is represented by the double-headed arrow 32 while the pivotal motion of the arm 7 upon which the plate 1 is mounted is represented by the double-headed arrow 33. The axis of the blade 2 is represented at 34. In the position shown in FIG. 2 the blade 2 is accessible.

In this latter position, the blade 2 poses a danger to the operator when the thickness of the slice to be cut is sufficiently great that the plate 5 is shifted out of the plane of the blade 2 by an amount enabling the operator to contact the cutting edge 35 of the blade. It will be understood that in a slicing machine of this type, the plate 5 is adjusted relative to the plane of the cutting edge 35 and perpendicular to the plane of the paper in FIGS. 1 and 2 by at least the thickness of the slice or to establish that thickness.

The carriage 3 is displaceable along a machine bed 4 perpendicular to the axis 34 and along the adjustable stop plate 5 back and forth as represented by the double-headed arrow 9. On the carriage 3 a bar 6 is mounted which extends parallel to the axis 34 and perpendicular to the plane of the paper in FIGS. 1 and 2.

The arm 7 is mounted to slide along the bar 6 perpendicular to the plane of the paper and to swing upwardly and downwardly between the positions shown in FIGS. 1 and 2 as represented by the arrow 33. The arm 7 extends over the loading region of the carriage 3 and carries the pusher plate 1 previously described which urges the product 8 to be sliced against the stop plate 5.

Consequently, with the blade 2 rotating, the plate 5 set back from the plane of the edge 5 by the thickness of the slice, the plate 1 in the position shown in FIG. 1, a manual displacement of the carriage 3 or the displacement of the carriage 3 by a drive in the direction of the arrow 9 back and forth, while the plate 31 is pressed toward the plate 5, will result in the slicing of the product 8 to form a number of slices in succession which may have different thicknesses, depending upon the adjustment of the plate 5, a typical slice thickness being about 2 mm. In that case, the stop plate 5 is set back from the plane of the blade 2 by 2 mm. During this operation, the arm 7 is in the position shown in FIG. 1 and slides along the bar 6 in the direction of the stop plate 5.

The arm 7 is provided with a projection or nose 10 which, upon swinging of the arm into its upper position, engages a swingable strip 11 to displace this strip about its axis 12 in the counterclockwise sense (compare FIGS. 1 and 2) into the position shown in FIG. 2. The strip 11 is connected by a link 13 with a magnetic strip 14.

The magnetic strip 14 is mounted on the carriage 3 for displacement therewith parallel to the machine bed 4 back and forth with the carriage. Toggle linkages 15 or the like connect the magnetic strip 14 with the carriage and the magnetic strip 14 is braced by the springs 16 toward the position shown in FIG. 2 in which the magnetic strip 14 is at a maximum distance from the carriage. The toggle linkages 15 and the spring 16 are provided in pairs so that the magnetic strip 14 is moved parallel to itself when it is pulled up by the link 13 (see FIG. 2).

The magnetic strip 14, when it approaches the bed 4, is juxtaposable with reed switches 17 and 18 provided on the machine bed. These reed switches contain contacts which are normally open but close in the presence of the permanently magnetic strip 14.

The reed contact 17 in FIG. 1 is therefore closed since the magnetic strip 14 is in its lower position into which it is braced by the springs 16 in the absence of engagement by the projection 10 of the pivotal strip 11.

The circuit 19 is energized controlling the drive 20 for adjustment of the plate 5 and back and forth displacement of the carriage 3, the stop plate 5 being shifted out of the plane of the blade for each slicing operation before the product 8 reaches the edge 35 and being returned to the plane of the blade when the product 8 is again shifted to the left after a slice has been formed.

The switch 17, in its closed position, also allows energization of the control circuit 21 for the motor drive 22, i.e. the controller of the motor 30.

As a consequence, the circuits 19 for the thickness adjustment drive 20 and the controller 21 for the motor system 22, 30 can only be energized while the reed switch 17 is closed.

When the carriage 3 is moved into the position shown in broken lines in FIG. 1, the strip 14 approaches the previously open reed contact 18 an closes the latter before leaving the reed contact 17 sufficiently to allow it to open. The voltage is then applied to the controllers 21 and 19 through the now closed reed switch 18.

When, however, the clamping device 1 is raised (FIG. 2) the projection 10 engages the strip 11 and rotates it about the pivot 12, thereby drawing the link 13 upwardly and raising the strip 14. The magnetic field of the strip 14 can no longer close the reed contacts 17 and 18 so that these remain open even if the carriage 3 is displaced back and forth over the reed contacts 17 and 18.

Opening of the reed contact 17 and 18 de-energizes the controller 19. Failure of the signal at 19 causes the stop plate 5 to shift from its cutting position into the plane of the blade (zero cutting thickness or set back) to shield the edge 35 of the blade. The stop plate 5 can also be positioned ahead of the blade plane (negative slice thickness) if desired to shield the blade edge.

The control 21 likewise receives no signal so that the motor system 22, 30 is shut down and the usual blade brake can prevent overrunning of the blade.

When the carriage 3 is shifted in the open position of the clamping device 1, the magnetic strip 14 remains in its retracted position so that the reed switches 17 and 18 cannot be closed. This, of course, provides maximum reliability against injury from the slicing machine.

When the carriage 3 is swung out about the axis 23 from the plane of the paper for cleaning purposes, the magnetic strip 14 is also removed from any possibility of approach to the reed switch 17 and 18 so that the blade motor system 22, 30 is switched off or cannot be switched on, and the stop plate 5 will assume its protective position in the blade plane or ahead of the latter. This effect is also of special significance from a safety point of view.

I claim:

1. A slicing machine, comprising:

a slicing-machine bed;

motor means on said bed for actuating a blade to rotate about an axis in a blade plane perpendicular to said axis;

carriage means mounted displaceably on said bed transversely to said axis for slicing a product as said carriage is moved past a cutting edge of said blade;

a stop plate mounted on said bed and disposed alongside said blade;

a bar mounted on said carriage and extending parallel to said axis;

a clamping device mounted swingably on said bar between an operative lower position and an inoperative upper position and displaceable along said bar parallel to said axis upon slicing said product; and detecting means on said bed actuatable upon swinging of said clamping device independently of a position of said clamping device along said bar and operatively connected with said motor means for inactivating said motor means upon detecting of the clamping device in said upper position during slicing of said product, said detecting means comprising:

a magnetic strip extending on said carriage in a direction of displacement, and at least one reed switch mounted on said bed, and juxtaposed with said magnetic strip, said clamping device including:

an arm mounted swingably on said bar and being displaceable along said bar toward and away from said stop plate;

a pusher plate carried by said arm and engageable with said product for urging same toward said stop plate, said arm being provided with a projection;

a pivotal strip pivotally mounted on said carriage and engageable by said arm; and a link connecting said magnetic strip with pivotal strip for drawing said magnetic strip away from said reed switch upon swinging of said arm into said upper position of said device.

2. A slicing machine, comprising:

a slicing-machine bed;

means for rotatably mounting a slicing blade on said bed;

motor means on said bed for actuating said blade to rotate about an axis in a blade plane perpendicular to said axis;

a carriage for a product to be sliced displaceable on said bed transversely to said axis for slicing of said product as said carriage is moved past a cutting edge of said blade;

a stop plate mounted on said bed, disposed alongside said blade and shiftable on said bed between a slicing position wherein said plate is set back from said blade by a distance of at least a slice thickness and a shielding position wherein said stop plate is disposed forwardly of said slicing position and shields said edge against injury to an operator;

a drive for shifting said stop plate between said positions;

mounting means on said carriage for swingably mounting a clamping device between an operative lower position wherein said device urges a product on said carriage against said stop plate and an inoperative upper position, said clamping device comprising:

a bar mounted on said carriage and extending parallel to said axis;

an arm having one end swingably engaged with said bar and being displaceable along said bar toward and away from said stop plate;

a pusher plate carried by the other end of said arm and engageable with said product for urging same toward said stop plate, said arm being provided with a projection;

a lever pivotally mounted on said carriage and engageable by said projection of said arm; and detecting means positioned on said bed for detecting an upper position of said pusher plate, said detecting means comprising a magnetic strip extending on said carriage in a direction of displacement thereof and connected with said lever to shift with said carriage, and at least one reed switch mounted on said bed, and juxtaposed with said magnetic strip, said lever drawing said magnetic strip away from said reed switch upon swinging of said arm into said upper position of said pusher plate to inactivate said drive and motor means in said upper position of said pusher plate.

3. The slicing machine defined in claim 2 wherein said detecting means is constructed and arranged for generating an electrical signal representing said upper position of said clamping device.

4. The slicing machine defined in claim 3 wherein said signal is the opening of said switch, said switch being in circuit with said drive and said motor.

5. The slicing machine defined in claim 2 wherein a plurality of reed switches are provided along said bed with a spacing corresponding substantially to a length of said magnetic strip and connected in circuit with said drive and said motor.

6. The slicing machine defined in claim 2, further comprising a pair of toggle linkages connecting said magnetic strip with said carriage for movement of said magnetic strip parallel to itself by said arm.

7. The slicing machine defined in claim 6, further comprising a pair of springs braced between said magnetic strip and said carriage urging said magnetic strip toward said reed switch.

8. The slicing machine defined in claim 2, further comprising means for pivotally mounting said carriage to swing about an axis parallel to said direction for cleaning of said machine, said magnetic strip, upon swinging of said carriage, being removed from said reed switch thereby de-energizing said motor and said drive.

* * * * *